United States Patent [19]

Okamoto

[11] 4,376,577

[45] Mar. 15, 1983

[54] ELECTROSTATIC COPYING APPARATUS

[75] Inventor: Katsuhiko Okamoto, Yokohama, Japan

[73] Assignee: Tokyo Shibaura Denki Kabushiki Kaisha, Kawasaki, Japan

[21] Appl. No.: 237,947

[22] Filed: Feb. 25, 1981

[30] Foreign Application Priority Data

Feb. 29, 1980 [JP] Japan ..... 55-25116

[51] Int. Cl.[3] ..... G03G 15/00

[52] U.S. Cl. ..... 355/3 DR; 355/3 R

[58] Field of Search ..... 355/3 DR, 3 R, 11, 133

[56] References Cited

U.S. PATENT DOCUMENTS

| | | | |
|---|---|---|---|
| 3,736,053 | 5/1973 | Shreeve et al. | 355/8 X |
| 3,966,316 | 6/1976 | Pfeifer et al. | 355/3 DR |
| 3,997,262 | 12/1976 | Doi et al. | 355/11 |
| 3,998,548 | 12/1976 | Wakatsuki | 355/3 DR |
| 4,076,402 | 2/1978 | Kanno et al. | 355/3 DR |

*Primary Examiner*—R. L. Moses

*Attorney, Agent, or Firm*—Cushman, Darby & Cushman

[57] ABSTRACT

An electrostatic copying apparatus comprises a housing including a lower housing section and an upper housing section mounted on the lower housing section and capable of swinging to open the lower housing section, a photosensitive drum provided in the upper housing section, a support mechanism attached to the upper housing section for supporting the photosensitive drum to allow the drum to be rotated and detached, a guide mechanism attached to the lower housing section for guiding the photosensitive drum to one end of the lower housing section after the drum has been detached from the supporting mechanism, and at least one peripheral device provided within the upper housing section, put in contact with the photosensitive drum during copying operation and moved away from the photosensitive drum to allow the drum to be detached from the support mechanism. The upper housing section is swung open to allow the photosensitive drum to be taken from it. The copying apparatus further comprises a detect switch which is attached to the housing and which is closed by a specific operation necessary for taking out the photosensitive drum from the housing and a lamp which is provided within the housing for illuminating the outer periphery of the drum and which is turned on when the detect switch is closed.

10 Claims, 7 Drawing Figures

ELECTROSTATIC COPYING APPARATUS

This invention relates to an electrostatic copying apparatus having a photosensitive drum, and more particularly to an electrostatic copying apparatus which is provided with a housing comprised of an upper housing section and a lower housing section.

Generally an electrostatic copying apparatus comprises a housing and a photosensitive drum having a photosensitive layer laid on its outer periphery and being rotatably supported in the housing. The photosensitive layer gets dirty or has its electrostatic characteristic degraded upon lapse of a long time or upon producing a large number of copies. When the photosensitive layer becomes so dirty or loses its electrostatic characteristic so much that clear copies can no longer produced, the photosensitive drum is taken out of the housing and then is cleaned or replaced by a new one. The drum must be taken out very carefully lest it should touch and damage the complicated mechanism within the housing. To remove the drum from the housing is a troublesome job indeed.

To make it easier to take out the drum without damaging the mechanism disposed within the housing, use is recently made of a housing which comprises an upper housing section and a lower housing section. The upper and lower housing sections are mutually connected at one end by a pivotal connection means. Thus the upper housing section can be swung upward to open the lower housing section, whenever necessary. Even when the upper housing section is swung in this way, it is very dark in the lower housing section. The operator cannot therefore see well the mechanism inside the lower housing section and may mistakenly hit the photosensitive drum against the elements constituting the mechanism and thus damage them, while he is taking the drum out of the lower housing section. Much care should be taken in removing the drum, and much time is required to take the drum out of the lower housing section.

It is an object of this invention to provide an electrostatic copying apparatus with which it is easy to take out a photosensitive drum from a housing, thereby improving the operation efficiency of the apparatus.

According to an aspect of the present invention, there is provided an electrostatic copying apparatus which comprises: a housing including a lower housing section and an upper housing section mounted on the lower housing section and capable of swinging to open the lower housing section; a photosensitive drum provided in the upper housing section; a support mechanism attached to the upper housing section for supporting the photosensitive drum to allow the drum to be rotated and detached; a guide mechanism attached to the lower housing section for guiding the photosensitive drum to one end of the lower housing section after the drum has been detached from the supporting mechanism; and at least one peripheral device provided within the upper housing section, put in contact with the photosensitive drum during copying operation and moved away from the photosensitive drum to allow the drum to be detached from the support mechanism. The upper housing section is swung open to allow said photosensitive drum to be taken from it. The copying apparatus further comprises a detect switch which is attached to the housing and which is closed by a specific operation necessary for taking out the photosensitive drum from the housing and a light source which is provided within the housing for illuminating the outer periphery of the drum and which is turned on when said detect switch is closed.

This invention can be more fully understood from the following detailed description when taken in conjunction with the accompanying drawings, in which.

Figure 1:
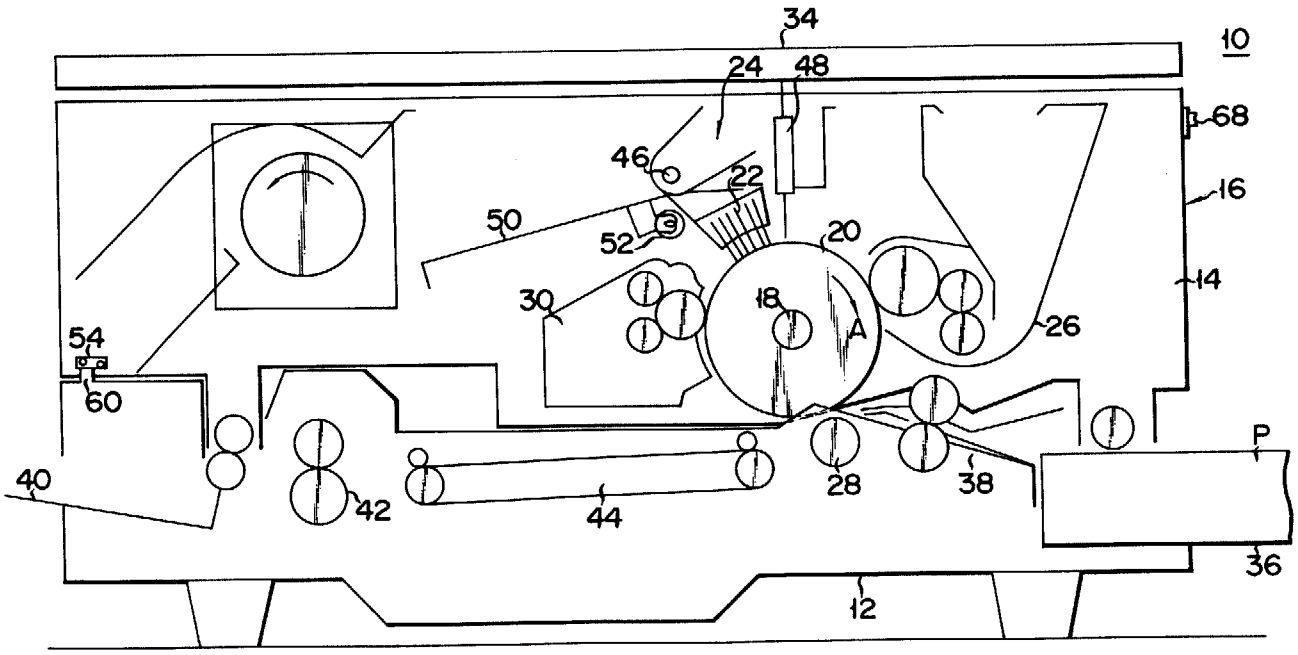
FIG. 1 is a cross sectional view schematically showing one embodiment of this invention.
Figure 2:
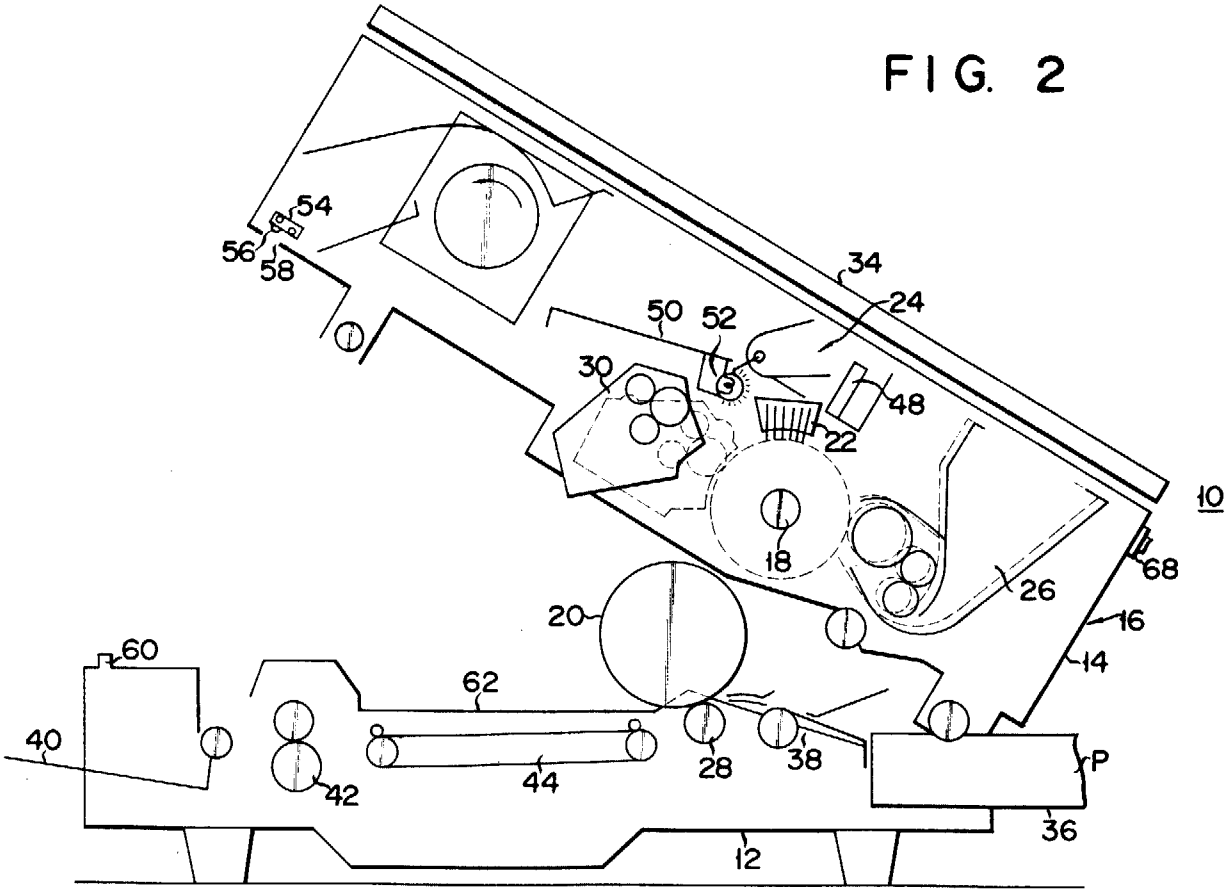
FIG. 2 is a cross sectional view schematically showing the apparatus of FIG. 1 which is put in a different operation state.
Figure 3:
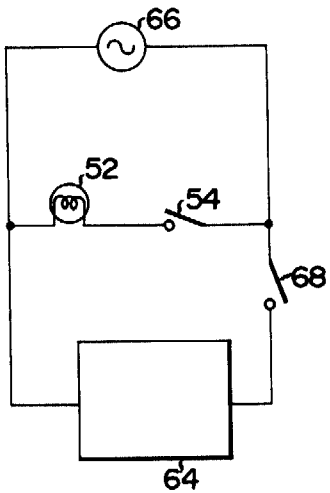
FIG. 3 is a circuit diagram illustrating the connection between a main switch (68) and a detect switch (54)

With reference to FIGS. 1 to 3, one embodiment of an electrostatic copying apparatus according to this invention will be described in detail.

As shown in FIG. 1, the apparatus 10 comprises a housing 16 which consists of a lower housing section 12 and an upper housing section 14. The upper housing section 14 is hinged to the lower housing section 12 so that it may swing upward to open the lower housing section 12. Substantially in the middle of the upper housing section 14 a support mechanism 18 is provided. The support mechanism 18 supports a photosensitive drum 20 in such a way that the drum 20 may rotate and may be detached from it. The photosensitive drum 20 is rotated in the direction of an arrow A by a drive mechanism (not shown).

About the photosensitive drum 20, a charging device 22, an exposure device 24, a developing device 26, an image transfer device 28 and a cleaning device 30 are arranged in this order in the direction that the drum 20 rotates. Of these peripheral devices, the image transfer device 28 is disposed within the lower housing section 12. The other peripheral devices are disposed in the upper housing section 14. All the peripheral devices but the exposure device 24 have at least one portion put in contact with the outer periphery of the drum 20 and thus work for copying operation.

A retreating mechanism (not shown) is provided to retreat the developing device 26. Another retreating mechanism (also not shown) is provided to retreat the cleaning device 30. The developing device 26 and the cleaning device 30 can be moved from their operative positions by the retreating mechanisms before the upper housing section 14 is swung upward. On the top of the upper housing section 14 there is provided a rest 34, on which an original is laid and which can move back and forth.

A paper feeder 36 is disposed partly within one end portion of the lower housing section 12. The paper feeder includes a cassette for containing a pile of copying paper sheets P. Within the lower housing section 12 is a first conveyor 38 which conveys copying paper sheets P from the paper feeder 36 to the image transfer device 28. Disposed partly within the other end portion of the lower housing section 12 is a tray 40 for receiving copying paper sheets P with an image transferred on them. A fixing device 42 is provided in the lower housing section 12 and close to the tray 40. Between the fixing device 42 and the image transfer device 28 there is disposed a second conveyor 44 for conveying copying paper sheets P from the image transfer device 28 to the fixing device 42.

The above-mentioned exposure device 24 comprises a light source 46 for illuminating the table 34 and a light focusing and guiding element 48. The element 48 receives the light reflected from the original set on the rest 34, focuses the light and apply the light thus focused onto the outer periphery of the photosensitive drum 20. A partition 50 is provided above the charging device 22, the developing device 26 and the cleaning device 30, thus separating the exposure device 24 from the devices 22, 26 and 30. The partition 50 prevents the light from the light source 46 from leaking to the devices 22, 26 and 30.

A lamp 52 is attached to the partition 50 and positioned below the partition 50 so as to illuminate most of the devices and elements which are provided within the housing 16. To turn on and off the lamp 52 a micro switch 54, as a detect switch, is attached to that end portion of the upper housing section 14 which usually lies right above the tray 40. The micro switch 54 has an actuator 56. The micro switch 54 is opened and thus turns off the lamp 52 when the actuator 56 is pushed onto it and is closed and thus turns on the lamp 52 when the actuator 56 partly pops out of it as shown in FIG. 2. Said end portion of the upper housing section 14 has a bottom plate with a hole 58 which lies right below the actuator 56 of the micro switch 54. The lower housing section 12 has a projection 60 which extends upward. The projection 60 is long enough to extend through the hole 58 of the bottom plate and to push the actuator 56 into the micro switch 54 as long as the lower housing section 12 and the upper housing section 14 are put together as illustrated in FIG. 1. Therefore, the micro switch 54 is closed every time the upper housing section 14 is swung upward to open the lower housing section 12 and is opened every time the upper housing section 14 is swung downward to close the lower housing section 12. The micro switch 54 thus turns on the lamp 52 when the upper housing section 14 is swung up and turns off the lamp 52 when the upper housing section 14 is swung down.

Lying horizontally on the lower housing section 12 is a guide mechanism 62 with one end portion extending below the photosensitive drum 20 and being spaced therefrom for a very short distance as long as the drum 20 remains at its operative position (FIG. 1). The guide mechanism 62 receives the photosensitive drum 20 when the drum is detached from the support mechanism 18 and thereafter guides the drum 20 to that end of the lower housing section 12 where the tray 40 is provided.

On the paper feeding side of the upper housing section 14 a main switch 68 is attached. When the main switch 68 is closed, power from a power source 66 shown in FIG. 3 is supplied to drive means 64 shown also in FIG. 3 which drive the devices and elements provided within the housing 16. The main switch 68 is connected to the micro switch 54 in such a manner as illustrated in FIG. 3. As shown in FIG. 3, the drive means 64 is connected to the power source 66 through the main switch 68, and the lamp 52 is connected to the power source 66 through the micro switch 54 and not through the main switch 68. Thus the lamp 52 is turned on and off by the micro switch 54, whether the main switch 66 is closed or not.

The photosensitive drum 20 is taken out of the housing 16 in the following way. First, the main switch 68 is opened, thus stopping power supply to the drive means 64. The micro switch 54 remains open because the actuator 56 is pushed in the switch 54 by the projection 60, and the lamp 52 emits no light at all. Then, the retreating mechanisms (not shown) are driven, thereby moving the developing device 26 and the cleaning device 30 away from the photosensitive drum 20. This done, the drum 20 is detached from the support mechanism 18 and subsequently put onto the guide mechanism 62. Thereafter, the upper housing section 14 is swung up, thus opening the lower housing section 12 as illustrated in FIG. 2. At the same time, the actuator 56 is moved out of the contact with the projection 60 and partly pops out from the micro switch 54, whereby the micro switch 54 is closed and starts emitting light. That is, the lamp 52 is turned on automatically every time the upper housing section 14 is swung up so that the drum 20 may be taken out.

As a result, not only the interior of the upper housing section 14 but the interior of the lower housing section 12 is illuminated by the lamp 52. Now that it is no longer dark in both housing sections 12 and 14, the operator can see well where the devices and elements are located. And the risk is reduced that he should hit the drum 20 against the devices and elements thereby to damage them, while he is taking the drum 20 from the lower housing section 12.

As mentioned above, the developing device 26 and the cleaning device 30 have been already moved far from the photosensitive drum 20 when the drum 20 is detached from the support mechanism 18. The drum 20 can never touch or damage either device while being moved from the support mechanism 18 to the guide mechanism 62.

Now, with reference to FIGS. 4 to 7 another embodiment of this invention will be described. In FIGS. 4 to 7, like and the same numerals are used to denote like and the same elements as those shown in FIGS. 1 to 3. And like and the same elements are not described in detail.

In this embodiment a micro switch 54 is closed to turn on a lamp 52 when a cleaning device 30 is moved away from a photosensitive drum 20 whereas, in the apparatus of FIGS. 1 to 3, the micro switch 54 is closed to turn on a lamp 52 when the upper housing section 14 is swung upward to open the lower housing section 12.

Figure 6:
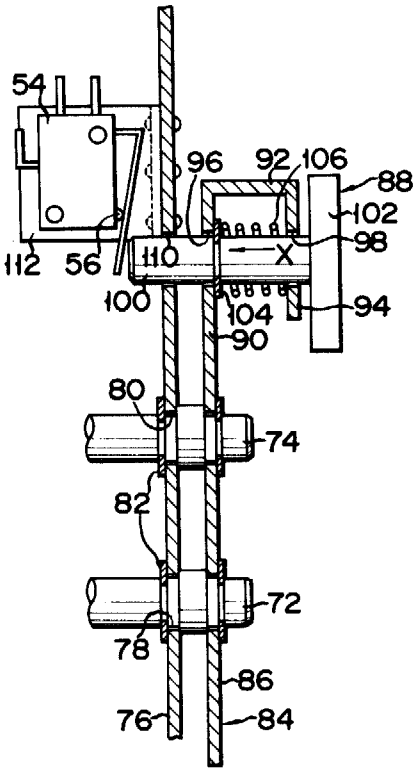
FIG. 6 is a cross sectional view taken along line VI—VI in FIG. 5.
Figure 4:
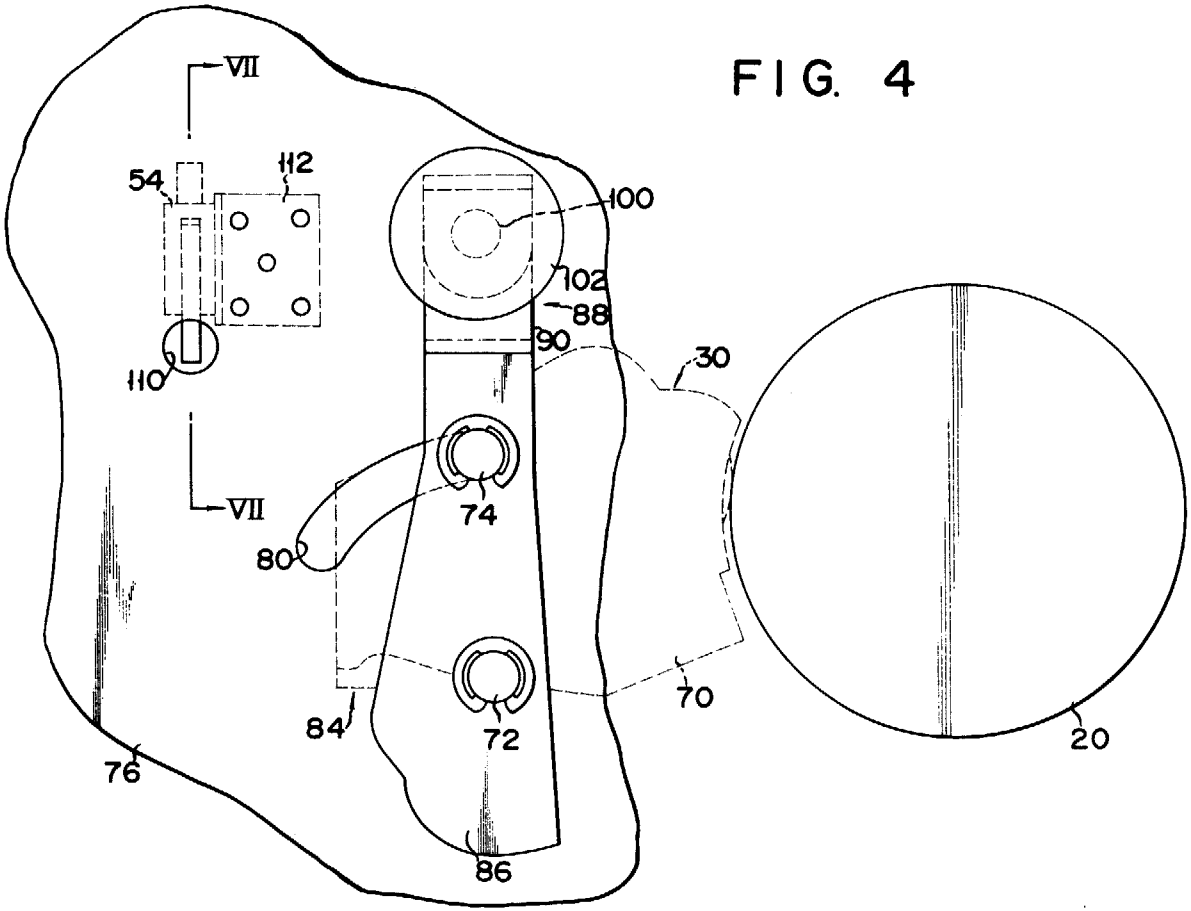
FIG. 4 is a front view of an important section of another embodiment of this invention.
Figure 5:
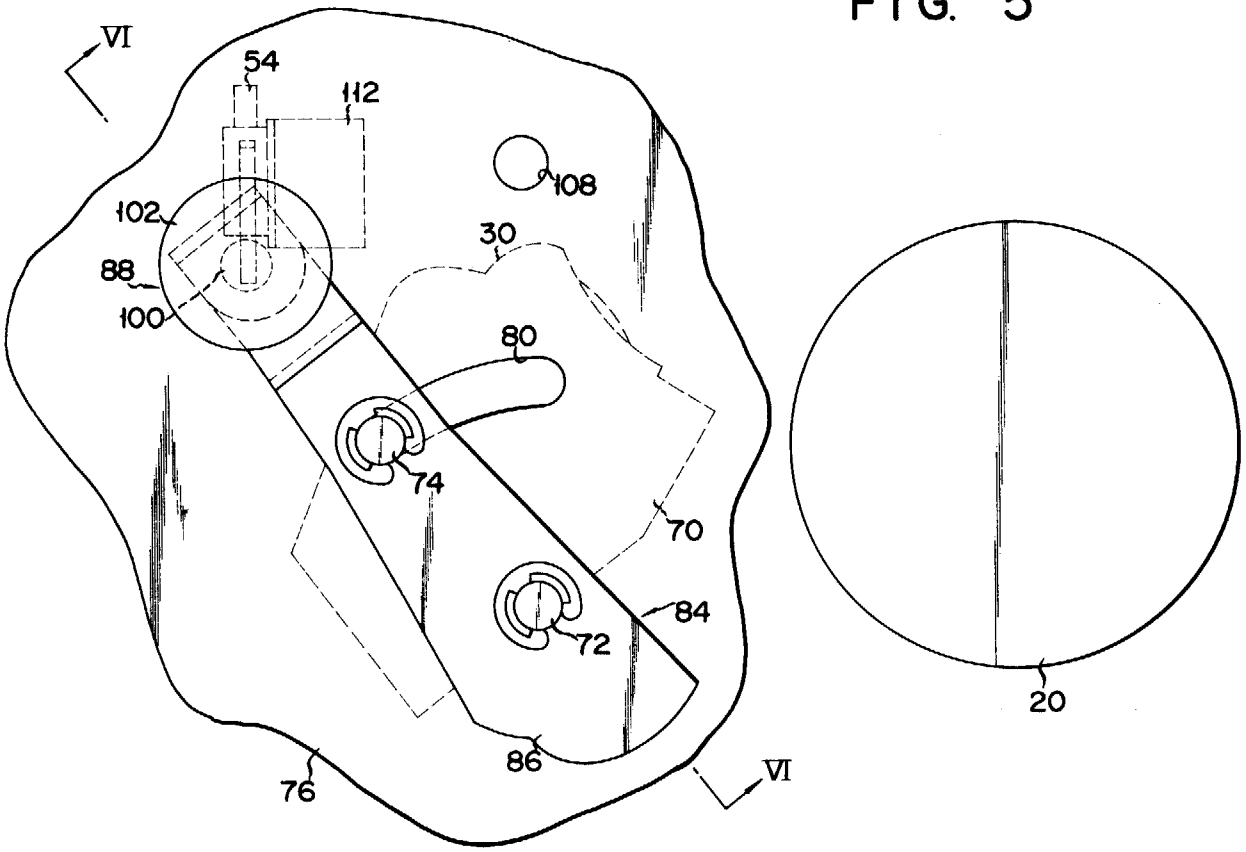
FIG. 5 is a front view of the important section shown in FIG. 4 which is put in a different operation state.

As shown in FIGS. 4 and 5, the cleaning device 30 has a plate 70 attached to it. From one side of the plate 70 there protrude a pivot pin 72 and a guide pin 74. These pins 72 and 74 are spaced for a predetermined distance. On the other hand, a plate 76 is attached to an upper housing section 14. The plate 76 has a round through hole 78 as shown in FIG. 6. It further has an arcuate elongated through hole 80, the center line of which is an arc whose center coincides with that of the hole 78. The pins 72 and 74 are inserted respectively in the holes 78 and 80 so that the plate 70 can rock about the pivot pin 72. As long as the guide pin 74 remains at one end of the arcuate elongated hole 80, the cleaning device 30 is kept in contact with the photosensitive drum 20. As the guide pin 74 is moved toward the other end of the arcuate elongated hole 80, the cleaning device 30 is moved away from the drum 20. The arcuate elongated hole 80 is so long that, when the guide pin 74 reaches the other end of the hole 80, the cleaning device 30 is located so far from the drum 20 as not to prohibit the drum 20 from falling from a support mechanism 18. As shown in FIG. 6, both the pivot pin 72 and the guide pin 74 are prevented by snap rings 82 from moving in their axial directions.

The cleaning device 30 further has a retreating mechanism 84. The mechanism 84 comprises a lever 86 and an engagement member 88. The lever 86 is secured at one end portion to the pivot pin 72 and at the middle to the guide pin 74. The engagement member 88 is attached to the other end of the lever 84. As shown in FIG. 6, said end portion of the lever 86 has a channel-shaped sectional profile. More specifically, the end portion consists of a portion 90 which extends perpendicular to the pins 72 and 74, a portion 92 which extends from the portion 90 outwardly at right angle and a portion 94 which extends from the portion 92 parallel to the portion 90 and which is spaced from the portion 90 at a distance substantially equal to the length of the portion 92.

The portions 90 and 94 have respectively through holes 96 and 98 which are axially aligned and which have the same diameter. The engagement member 88 consists of an engagement pin 100 and a knob 102 fixed to one end of the pin 100. The pin 100 extends through the holes 96 and 98. Mounted on the middle portion of the pin 100 is snap ring 104 which abuts on the portion 90 of the lever 86. Between the snap ring 104 and the portion 94 and around the pin 100 there is wound a coil spring 106 the ends of which are put in contact respectively with the snap ring 104 and the portion 94. The spring 106 urges the pin 100 in the direction of an arrow X, whereby the snap ring 104 is kept in contact with the portion 90 of the lever 86.

When the guide pin 74 stays at said one end of the arcuate elongated hole 80, the engagement pin 100 is inserted in a first through hole 108 made in the plate 76 which is, as mentioned above, attached to the upper housing section 14. On the other hand, when the guide pin 74 stays at the other end of the hole 80, the pin 100 is inserted in a second through hole 110 made also in the plate 76. As long as the engagement pin 100 is inserted in the first through hole 108, the cleaning device 30 remains in contact with the outer periphery of the photosensitive drum 20. As long as the pin is inserted in the second through hole 110, the cleaning device 30 remains far from the drum 20. To release the pin 100 from the hole 108 or 110 the knob 102 is pulled in the direction opposite to the arrow X, against the urging force of the spring 106.

Figure 7:
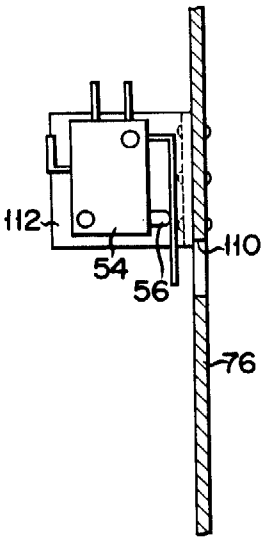
FIG. 7 is a cross sectional view taken along line VII—VII in FIG. 4.

As illustrated in FIG. 7, to the inner side of the plate 76 and near the second through hole 110 a support member 112 is secured by rivets. Secured to this support member 112 is the micro switch 54. The actuator 56 of the switch 54 is pushed in to close the switch 54 when the engagement pin 100 penetrates through the second through hole 110 as shown in FIGS. 5 and 6. The actuator 56 protrudes from the switch 54 and the switch 54 remains open as long as the pin 100 is outside the second through hole 110 as shown in FIGS. 4 and 7.

Now it will be described how to take out the photosensitive drum 20 from the housing 16 of the second embodiment of the invention. First, a main switch 68 is opened, thus stopping the power supply to the drive means 64. The micro switch 54 is still open, and the lamp 52 emits no light at all. Then, the knob 102 is pulled until the pin 100 is pulled out of the first through hole 108. This done, the lever 86 is rocked counterclockwise about the pivot pin 72 until the engagement pin 100 slips into the second through hole 110. As the lever 86 is rocked in this way, the cleaning device 30 is moved away from the photosensitive drum 20. When the guide pin 74 at last comes to the other end of the arcuate elongated hole 80, the cleaning device 30 can no longer prohibit the drum 20 from falling if released from the support mechanism 18. At the same time, the engagement pin 100 slips into the second through hole 110. As a result, the micro switch 54 is closed, the lamp 52 starts emitting light, and the interior of the housing 16 is no longer dark. The drum 20 is detached from the support mechanism 18 and subsequently put onto the guide mechanism 62. Thereafter the upper housing section 14 is swung up, thus opening the lower housing section 12. The drum 20 is moved to that end of the lower housing section 12 where a tray 40 is provided for receiving copies produced. Finally, the drum 20 is taken out of the housing 16.

As mentioned above, the lamp 52 is turned on automatically when the cleaning device 30 is moved away from the drum 20 so that the drum 20 is taken from the housing 16. Once the lamp 52 has been turned on, it is no longer dark in both housing sections 12 and 14. The operator can therefore see well where the devices and elements are located. The risk is reduced, just as in the first embodiment, that the operator should hit the drum 20 against the devices and elements thereby to damage them, while he is taking the drum 20 out of the lower housing section 12.

According to this invention it is essential that the lamp 52 be turned on by any operation carried out before the photosensitive drum 20 is taken out. Thus, the lamp 52 may be turned on when, for example, the developing device 26 is moved away from the drum 20.

What is claimed is:

1. In an electrostatic copying apparatus comprising:

a housing including a lower housing section and an upper housing section mounted on the lower housing section and capable of swinging to open the lower housing section;

a photosensitive drum provided in the upper housing section;

a support mechanism attached to the upper housing section for supporting the photosensitive drum to allow the drum to be rotated and detached;

a guide mechanism attached to the lower housing section for guiding the photosensitive drum to one end of the lower housing section after the drum has been detached from the supporting mechanism; and at least one peripheral device provided within the upper housing section, put in contact with the photosensitive drum during copying operation and moved away from the photosensitive drum to allow the drum to be detached from the support mechanism, wherein said upper housing section is swung open to allow said photosensitive drum to be taken from said housing, the improvement which includes:

a detect switch which is attached to the housing and which is closed by a specific operation necessary for taking the photosensitive drum from the housing; and a light source which is provided within the housing for illuminating the outer periphery of the photosensitive drum and which is turned on when said detect switch is closed.

2. An electrostatic copying apparatus according to claim 1, wherein said light source includes a lamp which is attached to the upper housing section.

3. An electrostatic copying apparatus according to claim 2, which further comprises a power source for supplying electric power to the peripheral device and a main switch for controlling the power supply to the peripheral device, wherein said lamp is turned on when the detect switch is closed irrespective of the state of the main switch.

4. An electrostatic copying apparatus according to claim 3, wherein said detect switch is attached to the upper housing section and is closed by swinging up the upper housing section.

5. An electrostatic copying apparatus according to claim 4, wherein said detect switch has an actuator urged to protrude from the detect switch, remains closed as long as the actuator protrudes from the detect switch and is opened when the actuator is pushed into the detect switch, and said lower housing section has a projection which pushes the actuator into the detect switch as long as the upper housing section closes the lower housing section and which releases the actuator when the upper housing section is swung upward to open the lower housing section.

6. An electrostatic copying apparatus according to claim 3, wherein said detect switch is closed when the peripheral device is moved away from the photosensitive drum.

7. An electrostatic copying apparatus according to claim 6, wherein said peripheral device includes a cleaning device for cleaning the outer periphery of the photosensitive drum.

8. An electrostatic copying apparatus according to claim 7, which further comprises a retreating mechanism for moving said cleaning device away from the photosensitive drum.

9. An electrostatic copying apparatus according to claim 8, wherein said retreating mechanism has a lever which supports said cleaning device and which is rocked thereby to move said cleaning device away from the photosensitive drum.

10. An electrostatic copying apparatus according to claim 9, wherein said detect switch has an actuator urged to protrude from the detect switch, remains open as long as the actuator protrudes from the detect switch and is closed when the actuator is pushed into the detect switch; and said lever has a pin which remains out of contact with the actuator as long as said lever keeps the cleaning device in contact with the photosensitive drum and which keeps pushing the actuator into the detect switch as long as the lever keeps the cleaning device out of contact with the photosensitive drum.

* * * * *